United States Patent [19]

Stevens et al.

[11] 4,440,048

[45] Apr. 3, 1984

[54] FASTENER DRIVING DEVICE WITH MULTIPLE BITS

[75] Inventors: Larry G. H. Stevens, Georgetown; Edmund G. F. Sweet, Oakville; Franklin V. Vresk, Kitchener, all of Canada

[73] Assignee: MIC Manufacturing and Machine Works Ltd., Waterloo, Canada

[21] Appl. No.: 281,785

[22] Filed: Jul. 9, 1981

Related U.S. Application Data

[63] Continuation-in-part of Ser. No. 165,707, Jul. 3, 1980, Pat. No. 4,327,790.

[51] Int. Cl.[3] ..... B25G 1/00

[52] U.S. Cl. ..... 81/440; 81/436; 81/450; 145/61 L

[58] Field of Search ..... 145/62, 63, 61 L; 81/437, 439, 440, 450, 436

[56] References Cited

U.S. PATENT DOCUMENTS

| | | | |
|---|---|---|---|
| 1,128,165 | 2/1915 | Mace | 81/450 |
| 2,726,695 | 12/1955 | Malm | 145/61 L |
| 3,919,541 | 11/1975 | Chao | 81/436 |
| 4,010,663 | 3/1977 | Rydberg | 81/440 |
| 4,327,790 | 5/1982 | Stevens et al. | 81/440 |

FOREIGN PATENT DOCUMENTS

| | | | |
|---|---|---|---|
| 1116575 | 1/1982 | Canada . | |
| 64530 | 9/1892 | Fed. Rep. of Germany | 81/440 |
| 464002 | 8/1928 | Fed. Rep. of Germany | 81/440 |

*Primary Examiner*—Frederick R. Schmidt
*Assistant Examiner*—J. T. Zatarga
*Attorney, Agent, or Firm*—Fleit, Jacobson, Cohn & Price

[57] ABSTRACT

A screwdriver comprises a handle having four screwdriver blades pivotally connected adjacent one end. The blades may be pivoted from a stored position alongside the handle to an operative position in advance of the handle. A locking device locks the blade in an operative position and comprises a disc rotatably mounted on the one end of the handle with a slot to engage the blade. The slot has a radial portion and a circumferential position so that the blade first enters the radial portion and the disc is then rotated to hold the blade in the circumferential portion.

28 Claims, 9 Drawing Figures

A

FASTENER DRIVING DEVICE WITH MULTIPLE BITS

This application is a continuation-in-part of Ser. No. 165,707 filed July 3, 1980, now U.S. Pat. No. 4,327,790 dated May 4, 1982.

The present invention relates to tools and in particular to a screwdriver having a plurality of blades.

Screws are now available in a number of different head configurations to suit different uses. The most common configurations are a sloted head having a single diametric slot, a "Philips" head having a cross-shaped recess and a "Robertson" head having a square recess. Each of these configurations requires a different screwdriver to drive the screw and it is therefore necessary to keep a number of different screwdrivers available.

Prior proposals to reduce the required number of screwdrivers has resulted in a body with a number of different bits insertable into the body. These bits are separate from the body and are therefore easly lost, resulting in additional inconvenience.

There is therefore, a need for a screwdriver which avoids the above disadvantages and which provides a choice of blades.

The present invention therefore provides a screwdriver in which a plurality of blades are pivotally connected to a handle. The blades are spaced about the axis of the handle and may be pivoted from a store position in which the blade lies alongside the handle to an operative position in which the blade extends forward from the handle. Lock means are provided between the handle and the blade to secure the blade in the operative position. Each of the blades is formed with a different end so that a plurality of different blades is provided.

The blades remain captive to the handle which prevents loss of the blades and the lock means ensures that the handle and blade are stable during use.

An embodiment of the invention will now be described by way of example only by reference to the accompanying drawings.

Figures 1, 2, 3, 4, 5:
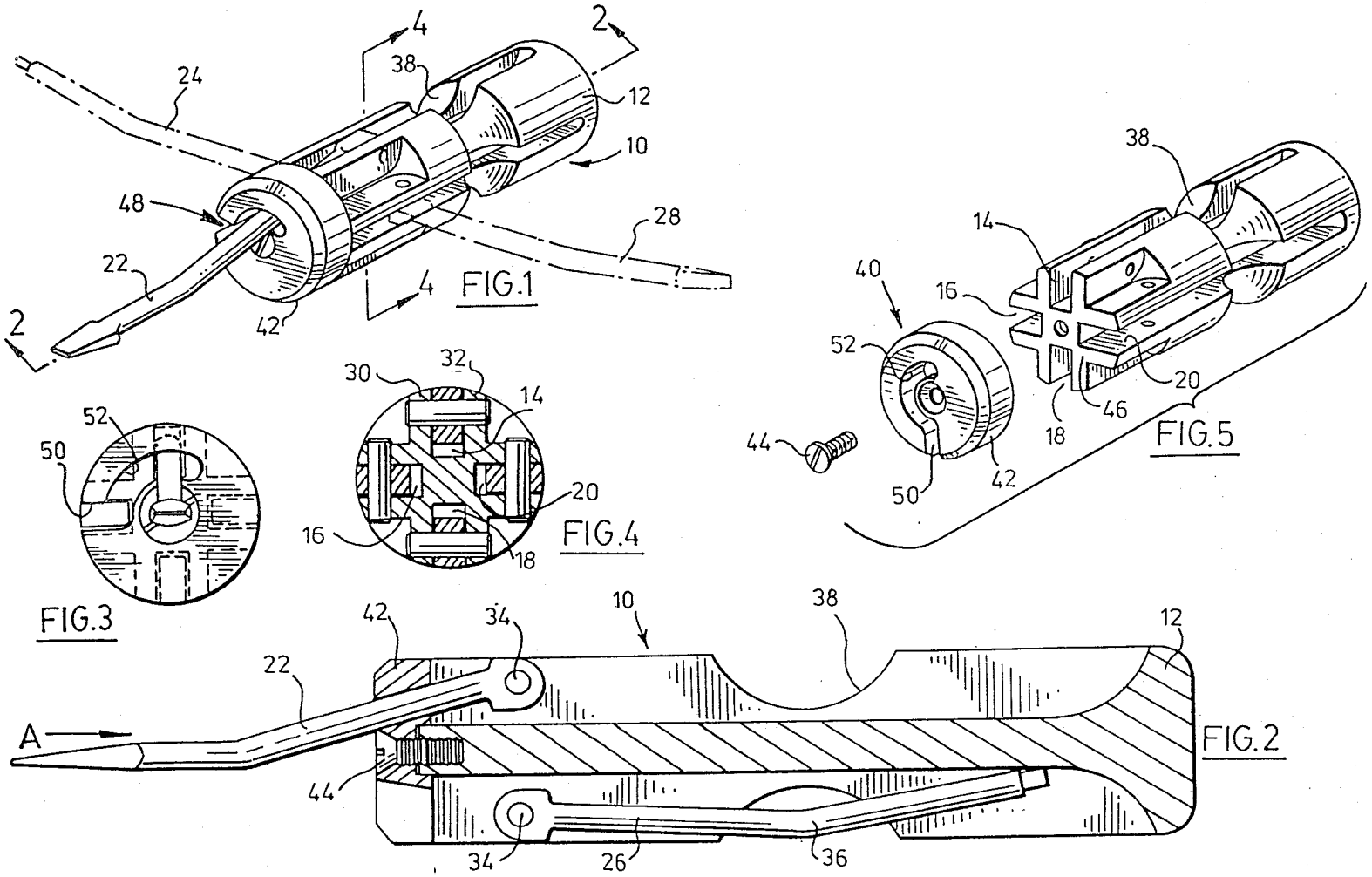
FIG. 1 is a perspective view of a screwdriver with a blade locked in an operative position.
FIG. 2 is a section on the line 2—2 of FIG. 1.
FIG. 3 is an end view in the direction of arrow A in FIG. 1.
FIG. 4 is a section on the line 4—4 of FIG. 2.
FIG. 5 is an exploded perspective view showing all the blades in a stored position.

Referring now to the drawings, a screwdriver 10 comprises a handle 12 having four recess 14, 16, 18, 20 extending parallel to the longitudinal axis of the handle. Each recess 14–20 accommodates a blade 22, 24, 26, 28 respectively. Each blade is formed with a different format so that two blades may be for Robertson screws of different sizes, one may be for a Philips screw and one may be for a slotted screw head. Obviously different combinations may be used as desired.

The handle 12 is scalloped at its lower or forward end to provide a pair of cheeks 30, 32 defining the lower portion of each of the recesses 14–20.

Each of the blades is pivotally secured to the handle 12 by a pin 34 extending between the cheeks 30, 32 of its respective recess. The blade may therefore pivot from a stored position in which the blade lies within the recess to an operative position in which the blade extends beyond the forward end of the handle.

The pins 34 are displaced radially from the longitudinal axis of the handle 12 and the blades 22–28 are cranked intermediate their ends, as at 36, so that in the operative position, the blade end lies on the longitudinal axis. A circumferentially extending notch 38 is formed in the handle 12 to intersect the recesses 14–20 adjacent the crank 36. This provides a convenient location to grip the blade for pivotal movement from the stored to the operative positions.

The blade is locked in its operative position by a locking device 40 which comprises a disc 42 rotatably mounted on a screw 44. The screw 44 is tapped to the handle 12 on the longitudinal axis and holds the disc 42 against an end face 46 of the handle 12. A notch 48 is cut into the disc 42 and includes a radial portion 50 and a circumferential portion 52. To lock the blade in a operative position, the radial portion 50 is aligned with the recess 14–20 of the required blade. The blade is then pivoted from the stored position to the operative position so that it enters the radial portion 50. The disc 42 is then rotated to move the circumferential portion around the blade and hold it in an operative position. After use, the blade may be stored by simply reversing the above procedure.

The blades not being used remain within the periphery of the handle 12. However, where extra leverage is required, two diametrically opposed blades may be lowered as indicated in dotted lines on FIG. 1 to act as a tommy bar.

The handle 12 may be machined from suitable material such as an aluminum alloy or may be molded from a suitable plastics material. Where a molded handle is utilized, extra strength may be built into the screwdriver by forming the pivots on a metal spider which is molded integrally with the handle 12.

It will be seen that a screwdriver having a plurality of captive blades is disclosed which provides the desired versatility to accommodate different screw formats without the disadvantages attendant with prior art devices.

A further embodiment of the invention may be seen from FIGS. 6 to 9 in which a battery operated light is incorporated into the screwdriver to provide illumination for the work area. This embodiment will now be described with similar components being indicated by similar reference numerals to those in FIGS. 1 to 5 with the suffix "a" added for clarity of description. As can be seen in FIGS. 6 to 9, the overall shape of the handle differs somewhat from that in the first embodiment of the invention. The handle **12*a* tapers in both directions from the mid-portion in which the circular recess 38*a* is formed. A generally cylindrical boss 60*a* delimits the forward end of the handle 12*a* and has a groove 62 extending circumferentially around the boss 60*a***.

In this embodiment, the handle is molded from a suitable plastics material such as that sold by Dupont under the trade name DELRIN 100. Four blades **22*a*–28*a* are provided as in the previous embodiment, together with their associated slots 14*a*, 20*a*. However, in this arrangement the slots are spaced at 72° intervals so that a fifth position on the handle 12***a* is provided. The handle 12*a* is formed with a longitudinal bore 64*a* extending from the end face 46*a* of the handle 12*a*. The bore 64*a* extends generally parallel to the longitudinal axis of the handle 12*a* but is displaced radially therefrom.

The bore 64*a* is adapted to receive a pair of batteries 65*a* of standard size and voltage. A contact strip 66*a* extends from the blind end of the bore 64*a* to the general vicinity of a bulb holder 68*a*. One end 70*a* of the contact strip 66*a* is hooked and extends radially across the bore. An elongate leg 72*a* of the strip 66*a* extends along the bore 60*a*. The end 70*a* is therefore in a position to contact one terminal of the battery. The bulb holder 68*a* is received in the end of the bore 64*a* and holds a bulb 74*a* in contact with the other end of the battery 65*a*. The load imposed by the batteries on the hooked end 70*a* of contact strip 66*a* biases the leg 72*a* away from the bulb holder and into contact with a switch member 76*a* which is mounted in the handle 12*a*. The switch member 76*a* comprises a cam member 78*a* rotatably supported on a pin 80*a* which is supported in the handle 12*a* on an axis generally parallel to the longitudinal axis of the handle. A circumferential force applied to the switch member 76*a* causes the cam 78*a* to rotate about the pin 80*a* and moves the leg 72*a* into contact with the outer terminal of the bulb 74*a*. The circuit between the battery and the bulb is therefore completed and the bulb 74*a* provides illumination for the work area.

The blades 22*a* to 28*a* are pivotally secured to the handle 12*a* by pins 34*a*. They may thus be pivoted from a stored position in which they lie generally parallel to the longitudinal axis of the handle 12*a* to an operative position in which they extend forwardly of the handle 12*a*. The position of the bulb 74*a* prevents the use of the locking device 40 shown in the embodiments of FIGS. 1 to 5. Clearly it is necessary to provide a locking device 40*a* which does not extend across the end face of the handle 12*a*. This is provided by means of a cylindrical ring 82*a* which is rotatably supported on the boss 60*a* and has a circumferential rib 84*a* which cooperates with the groove 62*a* to locate axially the ring 82*a*. A shoulder 88*a* extends across the end face 46*a* to cover the end of the pin 80*a* and located it in the handle 12*a*. The outer surface 90*a* of the ring 82*a* is hexagonal to assist in its rotation and the inner surface 92*a* is circular but eccentric to the axis of rotation of the ring 82*a*. The maximum eccentricity is aligned with a slot 86*a* so that the inner surface 92*a* defines a cam surface. A radial discontinuity or slot 86*a* is provided in the ring 82*a* to allow the blades to pass from the stored position into the operative position. Therefore in order to move the blade from the stored to the operative position, the slot 86*a* is aligned with the appropriate one of the recesses 14*a* to 20*a* and the blade is pivoted about its pin 34*a* into the operative position. The blade may then be locked into position by rotation of the ring 82*a* on the boss 60*a*. Rotation of the ring 82*a* brings the inner surface 92*a* into contact with the bit to firmly located the bit in the operative position.

Figures 6, 9:
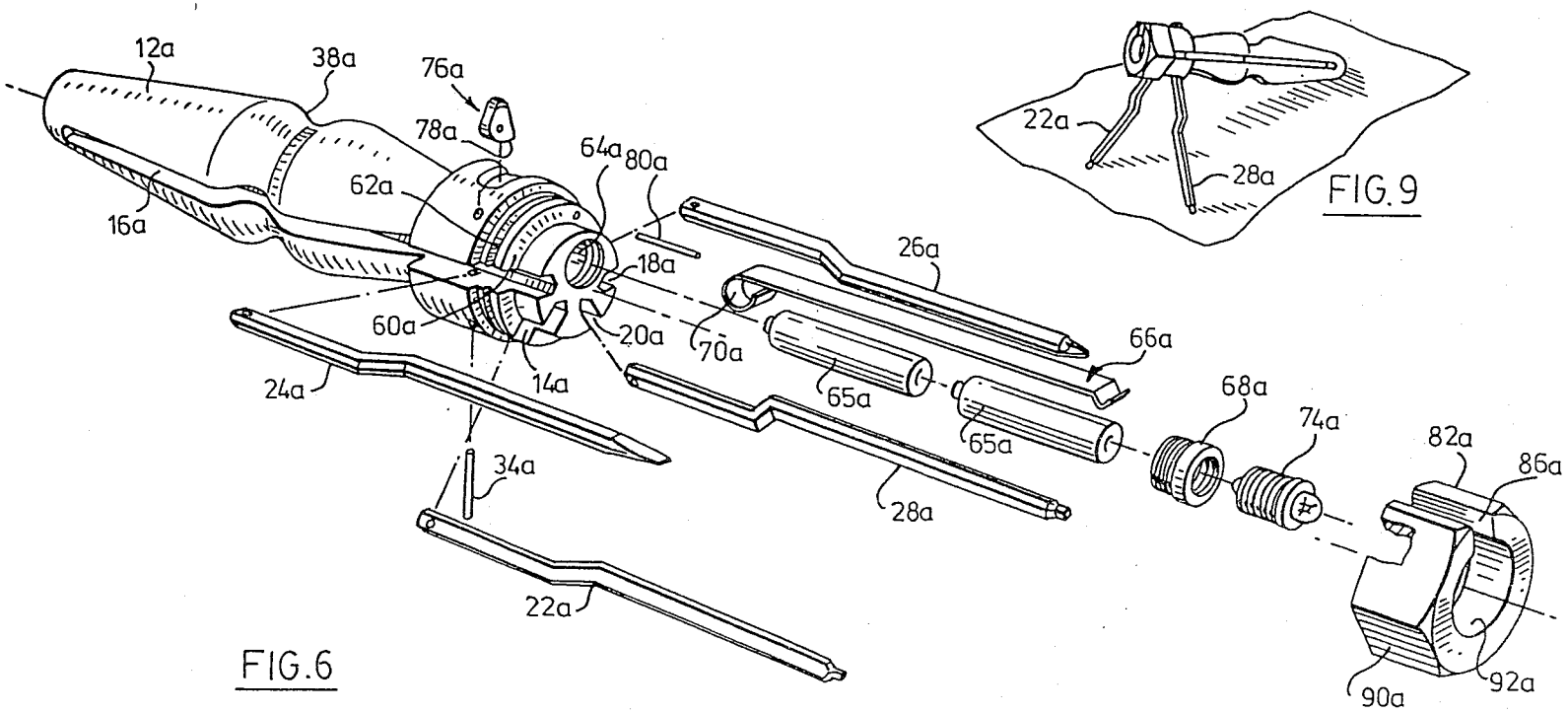
FIG. 6 is an exploded perspective view of a further embodiment of a screwdriver incorporating a light.
FIG. 9 is an illustration of the screwdriver of FIG. 6 being used as a light source.
Figures 7, 8:
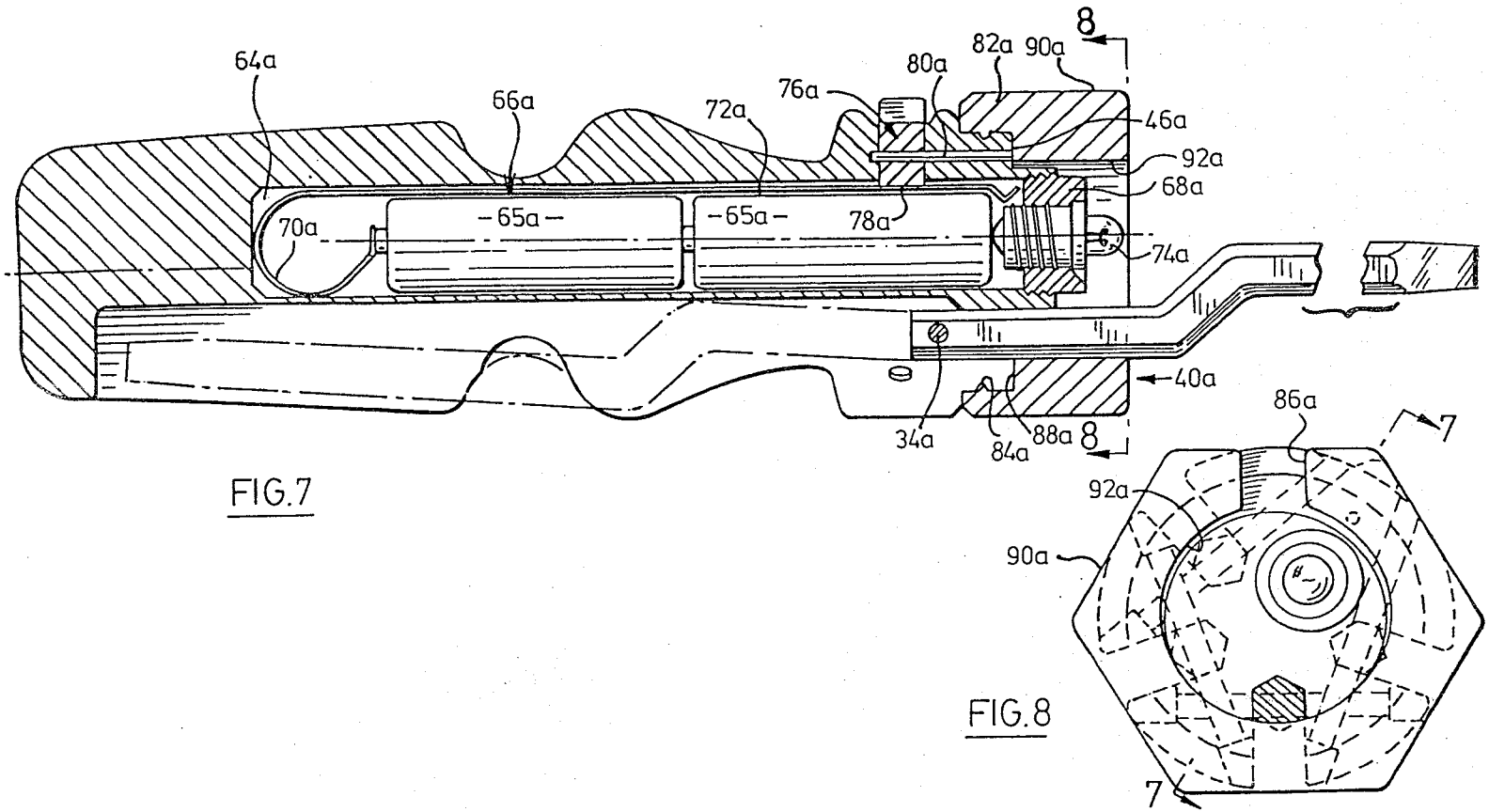
FIG. 7 is a longitudinal section of the screwdriver of FIG. 6 in the assembled condition.
FIG. 8 is a view on the line 8—8 of FIG. 7.

The additional blades may also be used in the form of a tommy bar as illustrated in FIG. 1. The blades may also be used to provide a tripod as shown in FIG. 9 to support the light in a position in which it may illuminate the work area even though the screwdriver is not being used. In this position, the ring 82*a* provides a positive stop for the blades 34*a* to hold the legs in a stable position.

This embodiment therefore provides a screwdriver in which a plurality of blades are held captive with the body of the screwdriver whilst permitting each blade to be used in a conventional manner. Furthermore locking means are provided to positively hold the blade in position and the provision of the battery operated lamp increase the overall utility of the device. Furthermore the lamp may be used separately and may be maintained in a stable position by using two of the blades as legs of a tripod.

Various modifications may be made to the device without departing from the scope of the invention. For example, the number of blades may be varied to suit the particular market requirements and if preferred a number of blades may be pivotally connected at each end of the handle. In this case the blades may be arranged in staggered fashion at opposite ends or may extend less than half the length of the handle.

Whilst the above description has used the term screwdriver it will be readily apparent that the device may be used to drive other forms of rotatable fastening, such as hexagonal bolts, by use of a suitable bit format.

The handle may also incorportae a ratchet device if desired to facilitate driving of the fasteners. Similarly, one of the bits may be in the form of a screw starter to provide a full range of tools for the user.

What we claim is:

1. A driving device for driving rotatable fasteners, said driving device comprising a handle, a plurality of driving bits spaced about said handle, pivot means pivotally connecting each of said bits to said handle adjacent to one end thereof for movement of each of said bits from a stored position in which said bit lies alongside said handle to an operative position in which said bit extends beyond said one end of said handle and lock means rotatably supported on said handle and operable between said bit and said handle to lock said bit in said operative position, said lock means including a passageway selectively alignable with each of said bits by rotation of said lock means relative to said handle, said bit passing through said passageway in moving from said stored to said operative position said lock means having an abutment surface adjacent said passageway, rotation of said lock means relative to said handle moving said abutment surface into alignment with said bit to prevent pivotal movement thereof about said pivot means, said pivot means being located on said handle relative to said lock means for movement of said bits from said stored position toward said operative position regardless of the position of said lock means.

2. A driving device according to claim 1 wherein said bits are located within recesses in said handle in said stored position.

3. A driving device according to claim 1 wherein said lock means comprises a slotted cap rotatably mounted on one end of said handle, said cap including said passageway and said abutment surface whereby rotation of said cap moves said bit and said abutment surface into alignment to hold said bit in said operative position.

4. A driving device according to claim 3 wherein said slot includes a radial portion and a circumferential portion, said abutment surface defining a radial outer edge of said circumferential portion, said bit initially entering said radial portion and entering said circumferential portion upon rotation of said cap.

5. A driving device according to claim 1 wherein said pivot means are spaced from the axis of said handle and said blades are cranked intermediate their ends to extend alongside said longitudinal axis in said operative position.

6. A driving device according to claim 2 wherein said lock means comprises a cap rotatably mounted on one end of said handle and having said passageway and said abutment surface formed therein, said abutment surface extending circumferentially around said cap for movement with said cap into alignment with said bit to hold said bit in said operative position.

7. A driving device according to claim 6 wherein said lock means comprises a cap rotatably mounted on one end of said handle and having said passageway formed therein, said cap being rotatable upon entry of said bit in said passageway to move a circumferential wall into alignment with said bit to hold said bit in said operative position.

8. A driving device according to claim 7 wherein said cap is in the form of a ring and said passageway includes a slot extending radially through said ring.

9. A driving device according to claim 8 wherein said circumferential wall defines a cam surface which engages said bit upon rotation of said cap.

10. A driving device according to claim 7 wherein said handle includes a bore and a light source is mounted in said bore, said light source being located radially inwardly of said ring so as to remain uncovered at all positions of said ring.

11. A driving device according to claim 10 wherein said light source is generated from a switch mounted on said handle.

12. A driving device according to claim 11 wherein said bore extends generally parallel to the longitudinal axis of said handle and is arranged to house an electric battery.

13. A driving device according to claim 1 wherein said pivot means includes pins extending between opposed walls of said recesses and passing through one end of said bit.

14. A driving device according to claim 1 wherein said lock means comprises a cap rotatably mounted on one end of said handle and having said passageway formed therein, said cap being rotable upon entry of said bit in said passageway to move a circumferential wall into alignment with said bit to hold said bit in said operative position.

15. A driving device for driving rotatable fasteners, said device comprising a handle, a plurality of bits spaced about said handle, pivot means pivotally connecting each of said bits to said handle for pivotal movement from a stored position in which said bit lies alongside said handle to an operative position in which said bit extends in advance of one end of said handle, lock means to hold said bit in said operative position, and a flashlight assembly located in said handle and producing a beam of light in advance of said handle to illuminate a bit in said operative position, a plurality of said bits being moveable about said pivot means to a position intermediate said stored position and said operative position to project outwardly from said handle, said plurality of bits and said handle constituting a tripod, to provide a stable support for said handle, in an inclined position on the ground and permit said beam of light to illuminate an elevated location and permit use thereof as a flashlight.

16. A driving device according to claim 15 wherein said bits are pivotally located adjacent said handle one end.

17. A driving device according to claim 16 wherein said flashlight assembly includes a bore located in said handle to receive a source of electrical energy and a bulb located in said bore at said one end of handle.

18. A driving device according to claim 17 wherein said handle includes at said one end a generally planar surface and said bore intersects said surface to provide a location for said bulb.

19. A driving device according to claim 18 wherein switch member is located on the exterior surface of said handle to operate said flashlight.

20. A driving device according to claim 19 wherein said flashlight assembly includes a conductor extending along said bore and moveable into engagement with said bulb by said switch member to complete the circuit between said electrical source and said bulb.

21. A driving device according to claim 20 wherein said switch member includes a cam pivotally connected to said handle and extending into said bore to engage said conductor.

22. A driving device according to claim 21 wherein said cam member is connected to said handle for pivotal movement about an axis generally parallel to the longitudinal axis of said handle.

23. A driving device according to claim 18 wherein said lock means includes an annular ring encompassing said planar surface and having a discontinuity therein to permit a bit to move from said stored to said operative position when said discontinuity is aligned therewith.

24. A driving device for driving rotatable fasteners, said device comprising a handle, a plurality of bits connected to said handle adjacent one end thereof and moveable from a stored position in which said bits lie alongside said handle to an operative position in which said bits extend beyond said one end of said handle, a flashlight assembly located in said handle and providing a source of light to illuminate a bit in said operative position, and lock means to hold said bits in said operative position.

25. A driving device according to claim 24 wherein said bits are connected to said handle at locations spaced from the longitudinal axis of said handle and each includes a crank to position a terminal position thereof on said longitudinal axis when in said operative position.

26. A driving device according to claim 25 wherein said flashlight assembly includes a bore located in said handle and extending from said one end to a location intermediate the ends of said handle, the axis of said bore being displaced to one side of said longitudinal axis and generally parallel thereto with a bulb being positioned in the bore adjacent said one end to illuminate a bit in said operative position.

27. A driving device according to claim 26 wherein said lock means includes an annular ring rotatably mounted on said handle adjacent said one end and having a discontinuity therein to permit said bit to move from said stored to said operative position, said bulb being located within the central aperture of said annular ring to permit illumination of a bit in said operative position.

28. A driving device according to claim 27 wherein said bits are pivotally connected to said handle by pivot means and said lock means is located between said one end and said pivot means to permit movement of a plurality of said bits to a position intermediate said stored and operative positions.

* * * * *